US009432774B2

(12) United States Patent
Bolsman

(10) Patent No.: US 9,432,774 B2
(45) Date of Patent: Aug. 30, 2016

(54) TRANSDUCER WITH A BENT ARMATURE

(71) Applicant: Sonion Nederland B.V., Hoofddorp (NL)

(72) Inventor: Caspar Titus Bolsman, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/675,956

(22) Filed: Apr. 1, 2015

(65) Prior Publication Data

US 2015/0289060 A1 Oct. 8, 2015

(30) Foreign Application Priority Data

Apr. 2, 2014 (EP) ..... 14163161

(51) Int. Cl.

| | |
|---|---|
| ***H04R 11/02*** | (2006.01) |
| ***H04R 25/00*** | (2006.01) |
| ***H04R 31/00*** | (2006.01) |
| *B06B 1/04* | (2006.01) |

(52) U.S. Cl.

CPC ..... *H04R 11/02* (2013.01); *H04R 25/604* (2013.01); *H04R 25/608* (2013.01); *H04R 31/006* (2013.01); *B06B 1/045* (2013.01); *H04R 2400/07* (2013.01)

(58) Field of Classification Search

CPC ..... H04R 11/00; H04R 11/02; H04R 11/04; H04R 11/06; H04R 11/14; H04R 25/604; H04R 25/608; H04R 31/003; H04R 31/006; H04R 2400/01; H04R 2400/07; B06B 1/045

See application file for complete search history.

(56) References Cited

U.S. PATENT DOCUMENTS 3,733,445 A * 5/1973 Sebesta ..... H04R 1/14 381/418
3,742,156 A * 6/1973 Broersma ..... H04R 11/00 381/386

(Continued)

FOREIGN PATENT DOCUMENTS

EP 2146521 A1 1/2010
KR 2014 0038232 A 3/2014

(Continued)

OTHER PUBLICATIONS

Extended European Search Report corresponding to co-pending European Patent Application Serial No. EP14163161.4, dated Sep. 25, 2014; (3 pages).

*Primary Examiner* — Curtis Kuntz
*Assistant Examiner* — Joshua Kaufman
(74) *Attorney, Agent, or Firm* — Nixon Peabody LLP

(57) ABSTRACT

A transducer having a housing defining a chamber, a bent armature with a first leg and a second leg, a magnet assembly for providing a magnetic field in an air gap, and a coil comprising a coil tunnel. The coil tunnel and the air gap extend substantially parallel or perpendicular to each other. Furthermore, the first leg extends in a first direction through the coil tunnel and the second leg extends in a second direction through the air gap.

15 Claims, 5 Drawing Sheets

(56) References Cited

U.S. PATENT DOCUMENTS 4,109,116 A * 8/1978 Victoreen ..... H04R 1/225 381/186
4,126,769 A * 11/1978 Broersma ..... H04R 7/04 381/418
4,272,654 A * 6/1981 Carlson ..... H04R 11/00 29/594
5,068,901 A * 11/1991 Carlson ..... H04R 1/225 381/325
5,193,116 A * 3/1993 Mostardo ..... H04R 11/02 381/324
5,222,050 A * 6/1993 Marren ..... H04R 11/00 181/132
5,647,013 A * 7/1997 Salvage ..... H04R 11/02 381/312
5,757,947 A * 5/1998 Van Halteren ..... H04R 11/00 381/322
5,809,158 A * 9/1998 van Halteren ..... H04R 11/00 381/322
6,041,131 A * 3/2000 Kirchhoefer ..... H04R 11/02 381/397
6,075,870 A * 6/2000 Geschiere ..... H04R 11/00 29/595
6,078,677 A * 6/2000 Dolleman ..... H04R 7/18 381/417
6,658,134 B1 * 12/2003 van Hal ..... H04R 11/02 381/417
6,788,796 B1 9/2004 Miles et al.
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 * 8/2006 Geschiere ..... H04R 25/604 381/324
7,110,560 B2 9/2006 Stenberg
7,110,565 B1 * 9/2006 Engbert ..... H04R 7/18 381/324
7,136,496 B2 11/2006 van Halteren et al.
7,142,682 B2 11/2006 Mullenborn et al.
7,181,035 B2 2/2007 van Halteren et al.
7,190,803 B2 * 3/2007 van Halteren ..... H04R 11/02 381/398
7,206,428 B2 4/2007 Geschiere et al.
7,221,767 B2 5/2007 Mullenborn et al.
7,221,769 B1 5/2007 Jorgensen
7,227,968 B2 6/2007 van Haltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosch et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 * 2/2009 Engbert ..... H04R 7/18 381/324
7,548,626 B2 6/2009 Stenberg et al.
7,577,269 B2 * 8/2009 Adelman ..... H04R 13/00 381/417
7,657,048 B2 2/2010 van Halteren et al.
7,684,575 B2 3/2010 van Halteren et al.
7,706,561 B2 * 4/2010 Wilmink ..... H04R 7/18 381/324
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
7,983,432 B2 * 7/2011 Grinnip, III ..... H04R 7/045 181/161
8,098,854 B2 * 1/2012 van Halteren ..... H04R 1/24 381/182
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
9,020,173 B2 * 4/2015 Burns ..... H04R 25/50 381/312
2002/0050377 A1 * 5/2002 Augustijn ..... H04R 11/02 174/559
2002/0146141 A1 * 10/2002 Geschiere ..... H04R 25/604 381/368
2003/0190053 A1 * 10/2003 van Halteren ..... H04R 11/02 381/418
2004/0151340 A1 * 8/2004 Miller ..... H04R 11/02 381/417
2004/0258260 A1 * 12/2004 Thompson ..... H04R 7/20 381/312
2005/0111688 A1 * 5/2005 Wilmink ..... H04R 7/18 381/396
2005/0276433 A1 * 12/2005 Miller ..... H04R 11/00 381/396
2006/0083400 A1 * 4/2006 Miller ..... H04R 11/00 381/396
2006/0215874 A1 * 9/2006 Jiles ..... H04R 7/10 381/417
2007/0036378 A1 * 2/2007 Saltykov ..... H04R 25/604 381/324
2007/0104340 A1 * 5/2007 Miller ..... H04R 11/06 381/182
2007/0121983 A1 * 5/2007 Jayanth ..... H04R 7/06 381/345
2008/0031481 A1 * 2/2008 Warren ..... H04R 1/1016 381/322
2009/0060241 A1 * 3/2009 Saltykov ..... A61N 1/36128 381/324
2009/0147983 A1 * 6/2009 Jiles ..... H04R 11/02 381/386
2010/0014700 A1 * 1/2010 Zhou ..... H04R 11/02 381/380
2010/0054509 A1 * 3/2010 Thompson ..... H04R 11/02 381/312
2010/0067730 A1 * 3/2010 Van Halteren ..... H04R 1/22 381/386
2011/0038503 A1 * 2/2011 Yang ..... H04R 1/22 381/380
2011/0182453 A1 7/2011 van Hal et al.
2011/0189880 A1 8/2011 Bondo et al.

(56) References Cited

U.S. PATENT DOCUMENTS

2011/0299708 A1 12/2011 Bondo et al.
2011/0299712 A1 12/2011 Bondo et al.
2011/0311069 A1 12/2011 Ambrose et al.
2011/0311088 A1* 12/2011 Nagumo ..... H04R 31/006 381/395
2011/0311089 A1* 12/2011 Nagumo ..... H04R 11/02 381/396
2011/0311090 A1* 12/2011 Nagumo ..... H04R 11/02 381/398
2011/0311091 A1* 12/2011 Nagumo ..... H04R 11/02 381/398
2012/0014548 A1 1/2012 van Halteren
2012/0027245 A1 2/2012 van Halteren et al.
2012/0087533 A1* 4/2012 Nageno ..... H04R 11/02 381/380
2012/0140966 A1 6/2012 Mocking et al.
2012/0155683 A1 6/2012 van Halteren
2012/0155694 A1* 6/2012 Reeuwijk ..... H04R 11/02 381/396
2012/0255805 A1* 10/2012 van Halteren ..... H04R 1/2873 181/199
2013/0028451 A1 1/2013 de Roo
2013/0058508 A1* 3/2013 Oosato ..... H04R 1/1075 381/162
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2013/0272564 A1* 10/2013 Miller ..... H04R 3/00 381/412
2014/0153737 A1* 6/2014 Geschiere ..... H04R 1/26 381/74
2014/0153755 A1* 6/2014 Hug ..... H04R 25/604 381/315
2014/0169583 A1* 6/2014 Huang ..... H04R 1/24 381/74
2014/0305735 A1* 10/2014 van Halteren ..... H04R 11/02 181/199
2014/0314253 A1* 10/2014 Zhou ..... H04R 1/02 381/162
2015/0010199 A1* 1/2015 Kim ..... H04R 11/02 381/417
2015/0207392 A1* 7/2015 Iwakura ..... H04R 11/02 310/25
2015/0289060 A1* 10/2015 Bolsman ..... H04R 11/02 381/417

FOREIGN PATENT DOCUMENTS

WO WO 2010/025351 A2 3/2010
WO WO 2010/025351 A3 3/2010
WO WO 2010/025351 A8 3/2010

* cited by examiner

TRANSDUCER WITH A BENT ARMATURE

CROSS-REFERENCE TO RELATED APPLICATION

This application claims the benefit of European Patent Application Serial No. 14163161.4, filed Apr. 2, 2014, and titled "A Transducer with a Bent Armature," which is incorporated herein by reference in its entirety.

FIELD OF THE INVENTION

The present invention relates to a transducer in which an armature is provided in the magnetic field of at least one magnet, and provided in a coil tunnel of a coil.

BACKGROUND OF THE INVENTION

Traditionally, transducer technology relies on the positioning of coil and magnet in one line to have a small and elongated transducer.

Bent armatures may be seen in e.g. EP2146521 and KR20140038232.

SUMMARY OF INVENTION

It is an object of embodiments of the invention to provide an improved transducer.

It is a further object of embodiments of the invention to provide a transducer which is more compact than traditional transducers.

Another object is to arrive at a transducer having a larger possible deflection of the membrane while keeping the form factor low.

According to a first aspect, the invention relates to a transducer comprising:

a housing defining a chamber, a bent armature having at least a first leg and a second leg, the first leg having a first length, and a bent portion interconnecting the first and second legs, a magnet assembly configured to provide a magnetic field in an air gap, and a coil comprising a coil tunnel, wherein the armature extends through the air gap and the coil tunnel and is fixed to the housing so that the second leg and at least a portion of the first leg, the portion extending from the bent portion and comprising at least 50% of the first length, are movable in relation to the housing.

The transducer may convert both ways between electrical power and sound, thus being applicable both as a receiver, such as a loudspeaker in a hearing aid, and as a microphone. Typically, the transducer is adapted to transform electrical energy into mechanical energy by movement of a leg of the U-shaped armature whereby sound waves may be created by movement of a membrane which may be coupled to the moving armature leg.

The transducer may be adapted to be fitted into any hearing aid such as a Behind-the-Ear (BTE) device, an In the Ear (ITE) device, a Receiver in the Canal (RIC) device, or any other hearing aid. In the context of the present invention, the term "hearing aid" shall be understood as an electromagnetic device which is adapted to amplify and modulate sound and to output this sound to a user, such as into the ear canal of a user.

The armature, coil and magnet assembly are provided, usually completely, in the housing. In the housing, one or more chambers may be defined. Often multiple chambers are defined by the inner housing walls and a membrane. Usually, two chambers are defined, one on either side of the membrane. Often, the armature and coil are provided in the same chamber. The magnet assembly may be provided in one chamber or may be divided into parts provided in different chambers.

The coil may comprise a number of windings defining the coil tunnel through which the armature extends. The coil may have a cross section, perpendicular to a longitudinal axis along the coil tunnel, which is circular, triangular, star-shaped, rectangular, rectangular with rounded corners, oval or any other shape.

The magnet assembly provides a magnetic field in an air gap through which the armature extends. The magnet assembly may be provided by a first and a second magnet portion positioned on opposite sides of the armature and defining an air gap between them. In one embodiment, the first and second magnet portions are separate magnets which provide the magnetic field. In an alternative embodiment, the first and second magnet portions are two parts of a single magnet, e.g. formed as a U-shaped magnet, or the magnet assembly may be formed by one or more magnets and a (for example U-shaped) yoke of a magnetically conducting material.

The armature is bent as opposed to straight or plane armatures which extend solely in one plane. The bent armature has a first and a second leg and an interconnecting, bent portion. A plane exists in which the first leg extends but wherein the second leg does not extend. The bent portion may be bent during production of the armature or may be initially provided in the desired shape.

Usually, the first and second legs are straight armature portions in a relaxed or non-operative state, even though any shape may in principle be used.

The armature may be made from any type of material, element and/or assembly able to guide or carry a magnetic flux. The armature may be electrically conducting or not.

The armature often has a flat cross section perpendicular to a longitudinal direction, such as when made from a piece of sheet material, so that the bending of the armature is well-defined (perpendicular to the width of the armature material). Usually, the width of the armature material is perpendicular to a plane in which both the first and second arms extend.

The bent portion may have any shape interconnecting the two legs. Thus, this portion may straight, U-shaped, S-shaped, V-shaped, L-shaped or the like, where the legs are attached to or extend from the bent portion in the respective, desired directions.

Naturally, the fastened or fixed portion of the first leg may be less than 50%, such as no more than 40%, such as no more than 30%, such as no more than 20%, such as no more than 10% of the first length. In a preferred embodiment, an end portion of the first leg is fastened so that virtually all of the first leg is movable in relation to the housing.

The legs may have the same or different lengths. In one embodiment, the second leg has a length of 90-110% of the first length.

Preferably, the second leg extends through the air gap. When the first leg is fastened to the housing, and when the moving force is applied to the armature by the magnetic field in the air gap, the largest translation or bending may be obtained when the second leg extends through the air gap. In this situation, the force applied may be used for bending/deforming both the second leg, the bent portion and the portion of the first leg.

In a particularly interesting embodiment, the armature is U-shaped, where the first and second legs are substantially parallel. In this embodiment, preferably, the second leg and the portion of the first leg are movable in a direction transverse to longitudinal directions of the first and second legs.

In the context of the present invention, three directions can be used to describe the bent or U-shaped armature. An X-direction which corresponds to the extent of the legs of the U-shaped armature. The dimension of the U-shaped armature in the X-direction may be designated "the length". A Z-direction which defines a line extending through both the legs of the U-shaped armature. The dimension of the U-shaped armature in the Z-direction may be designated "the height". A Y-direction which is perpendicular to both the Z- and the X-directions. The dimension of the U-shaped armature in the Y-direction may be designated "the width".

Then, the coil tunnel and the air gap may extend substantially parallel to each other, such as in the X-direction, whereby a centre line of the coil extends in the X-direction. Then, one of the second leg and the portion of the first leg extends through the coil tunnel and the other of the second leg and the portion of the first leg extends through the air gap. The legs may extend in the X-direction, such as when the two legs are positioned at different positions along the Z-direction.

When the coil tunnel and the air gap extend substantially parallel to each other, the transducer may be embodied as a stacked transducer where the term "stacked transducer" should be understood as a transducer comprising a coil and a magnet assembly which are arranged above each other in the Z-direction so that one leg of the U-shaped armature extends through the coil tunnel and the other leg extends through the air gap when the U-shaped armature is arranged so that the legs extend in the X-direction.

It should however be understood, that the term stacked does not imply that the coil and the magnet assembly must be arranged in direct contact with each other.

By providing the transducer as a stacked transducer, the transducer is more compact in the X-direction than a traditional transducer, in which the coil and the magnet assembly are arranged on line in the X-direction. Thereby the transducer may be arranged in a smaller module allowing for a deeper fit and better fit-rate.

Additionally, a more compact transducer may facilitate arrangement of the transducer in a module being shaped substantially as a cylinder, which may further improve positioning of the hearing aid, e.g. inside the ear canal of a user.

To further facilitate a compact transducer, the magnet assembly and the coil may be arranged substantially above each other in the Z-direction, i.e. substantially perpendicularly to the first and second directions or the first and second legs.

Another interesting embodiment of the invention is a transducer having an L-shaped armature, wherein the first leg extends in a first direction through the coil tunnel and the second leg extends in a second direction through the air gap, wherein the coil tunnel and the air gap extend transverse to each other, such as with an angle of at least 10 degrees to each other, such as at least 20 degrees, such as at least 40 degrees, such as at least 50 degrees, such as at least 75 degrees, such as around 90 degrees.

The L-shaped armature may be positioned so that the first leg extends in the X-direction and so that the second leg extends in the Z-direction, whereby the legs may extend substantially perpendicular to each other.

In an alternative embodiment, L-shaped armature may be positioned so that the first leg extends in the Z-direction and so that the second leg extends in the X-direction, whereby the legs may still extend substantially perpendicular to each other, but in the opposite directions.

The part of the first leg may be attached or fixed to an attachment point of the housing either directly or via one or more attachment elements. In one embodiment, the fixed end portion is glued and/or welded and/or soldered to the housing. It should be understood that the term "attached to" may also cover embodiments were the fixed end point forms part of the housing so that the armature is formed integrally with the housing.

In general, the bent may extend in the Z-direction. Each leg may have a length being a distance from the bent portion to an end thereof, i.e. from the bent portion to e.g. a fixed end portion and from the bent portion to a free end portion, respectively. Each leg may extend freely from the bent portion towards the ends portions, whereby at least 50% of the length of each leg is movable in the housing. By moving freely should be understood, that the legs or parts thereof are at least rotatable in relation to the housing. When the first leg comprises a fixed end portion being attached to the housing, a portion of this leg first leg may move during use of the device as only the part of the first leg being closest to the housing is prevented from moving relative to the housing, while the remaining portion of the first leg may move relative to the housing.

The legs and the bent portion may be a monolithic element or may alternatively be made from several parts. In one embodiment, the transitions between the legs and the bent portion are rounded, whereas the transitions in another embodiment form sharp corners. The first and the second legs may be substantially straight.

The legs may be movable in a direction transverse to the first and second directions or longitudinal directions/axes thereof, such as in a direction being transverse to the X-direction. As the movement of the legs may be caused by the operation of the coil and the magnet assembly, the legs may be movable in a direction which is substantially along magnetic field lines of the magnetic field. Thus, the coil may introduce an electromagnetic field in the armature, which field will flow through the armature and thus also through the part positioned in the air gap, whereby at least this part will move in a direction being substantially along magnetic field lines of the magnet assembly. Thus, this part may be movable in a direction of the magnetic field lines, such as a direction which is substantially along the Z-direction.

As mentioned above, the magnet assembly may comprise a first magnet portion and a second magnet portion. The magnet portions may be positioned above each other in the Z-direction. To facilitate a compact layout of the transducer, a first part of the coil and the first magnet portion may be positioned in an area between the first and second legs, whereas a second part of the coil and the second magnet portion may be positioned outside the area, thus forming a layered transducer in the Z-direction.

The first part of the coil should be understood as the part of the coil being positioned at one side of the armature portion extending in the coil tunnel, whereas the second part of the coil should be understood as the part of the coil being positioned at the other side of the armature portion. As an example, the first part of the coil may be positioned above the armature portion in the Z-direction, whereas the second part of the coil may be positioned below the armature portion in the Z-direction.

The transducer may further comprise a membrane which may be operationally attached to the armature, such as the second leg, such that movement of the armature is transferred to the membrane. It will be appreciated that movement of the membrane causes sound waves to be generated. In one embodiment, the second leg is operationally attached to the membrane by means of a membrane connecting member, such as a drive pin. Alternatively, the membrane may itself be attached to the second leg. Further alternatively, the armature may itself constitute the membrane or a part thereof The membrane may comprise a plastic material, such as a polymer, or alternatively a metal material such as aluminium, nickel, stainless steel, or any other similar material. The membrane may divide the chamber into two chambers as is described above.

The housing may comprise a sound opening. In embodiments, where the transducer is used as a receiver, this opening is a sound outlet. The membrane may be positioned between the sound opening and other elements of the transducer, such as the armature, the coil and/or the attachment point. The membrane may be positioned substantially above at least a part of the magnet assembly, e.g. the first magnet portion, whereby the membrane forms part of the stacked magnet assembly and coil, as this may add to the compactness of the transducer. In fact, part of the magnet assembly may be positioned on one side of the membrane and another part on the other side of the membrane.

The compact layout of the transducer may be improved by arranging a suspension attached to a fixation point in the housing. The suspension may extend in the housing, such as in the X-direction, and may be attached to the coil and/or the magnet assembly. Thus, the suspension may be arranged to at least partly support the magnet assembly and/or the coil. The suspension may be positioned between the membrane and the attachment point in the Z-direction. The suspension may extend into a space between the first and second legs.

The armature may comprise a first and a second support portion configured for supporting the armature in and fixing the armature to the housing. In one embodiment, the armature may be attached to the housing by these support portions. The support portions may be attached to the first leg. The first and second support portions may be attached to the housing and may extend parallel to the first leg, whereby the first leg and the two support portions together form an E, which may extend in the Y-direction.

The housing may comprise a top wall, a bottom wall, and one or more side walls extending between the top wall and the bottom wall. The top wall may form part of the outer surface of the housing and may be positioned highest in the Z-direction, whereas the bottom wall, also forming part of the outer surface, may be positioned lowest in the Z-direction. The side wall(s) may form the outer surfaces being positioned at each end of the housing in the X-direction.

The distance between the top wall and the bottom wall may be in the range of 0.5-5.0 mm, such as in the range of 1.0-3.0 mm, such as in the range of 1.5-2.5 mm. The distance between two opposed side walls or side wall portions may be in the range of 2.0-5.0 mm, such as in the range of 2.5-4.0 mm.

The width of the housing may be defined by two additional side walls or side wall portions being positioned at each end of the housing in the Y-direction. The distance between the two additional side walls may be in the range of 2.0-5.0 mm, such as in the range of 2.5-4.0 mm.

The chamber may have a volume in the range of 10-20 $mm^3$, such as in the range of 12-18 $mm^3$.

The armature may be arranged in the housing so that the distance between the attachment point and the fixation point is at least 10 percent of the distance between the top wall and the bottom wall in the Z-direction.

In one embodiment, the shape of the transducer in the X-Y plane is substantially rectangular, or even quadratic, whereas it in an alternative embodiment is substantially circular, thereby providing a very compact transducer.

It should be understood, that a skilled person would readily recognise that any feature described in combination with the first aspect of the invention could also be combined with the second aspect of the invention, and vice versa.

BRIEF DESCRIPTION OF THE DRAWINGS

Embodiments of the invention will now be further described with reference to the drawings, in which.

DETAILED DESCRIPTION OF PREFERRED EMBODIMENTS

It should be understood that the detailed description and specific examples, while indicating embodiments of the invention, are given by way of illustration only, since various changes and modifications within the spirit and scope of the invention will become apparent to those skilled in the art from this detailed description.

Figure 1:
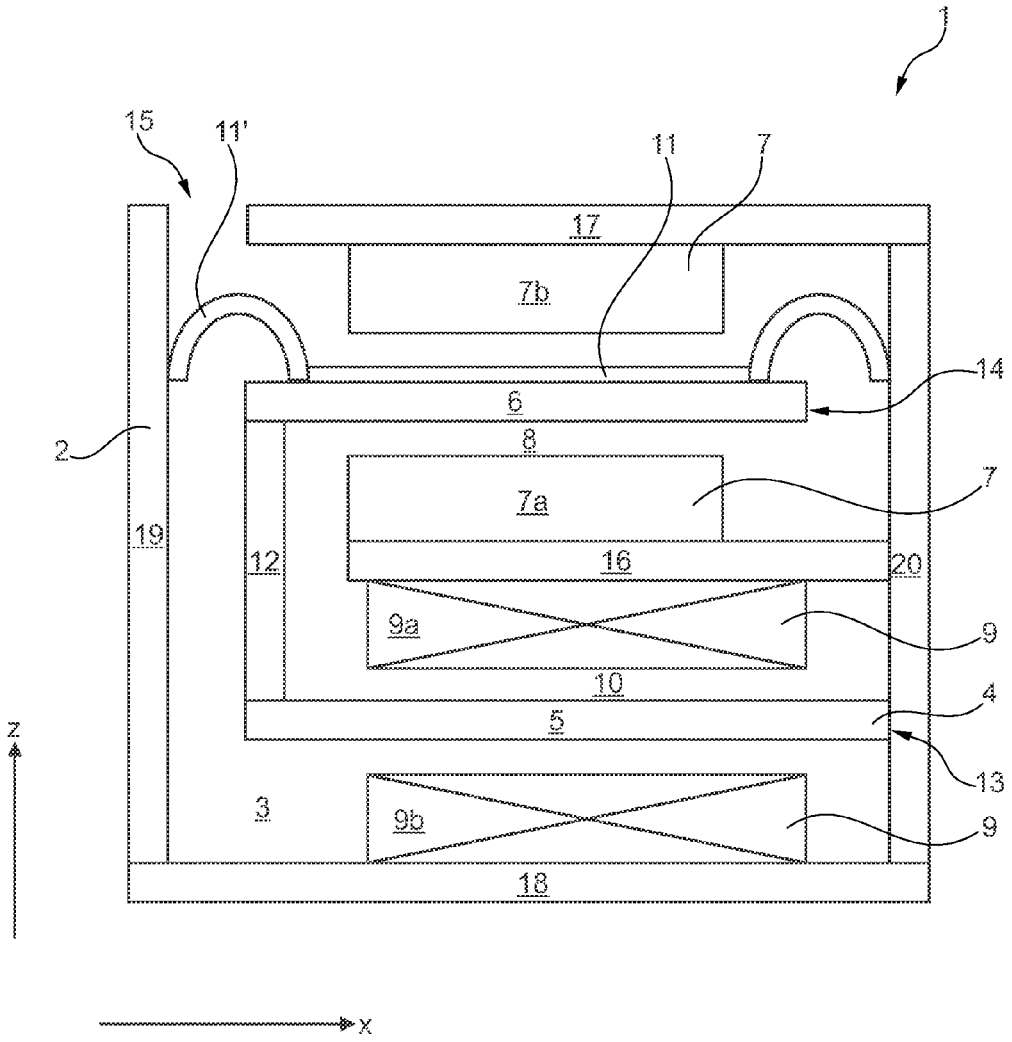
FIG. 1 schematically illustrates a first embodiment of a transducer according to the invention, FIG. 2 schematically illustrates a second embodiment of a transducer according to the invention.

FIG. 1 illustrates an embodiment of a transducer 1. The transducer 1 comprises a housing 2 defining a chamber 3, and a U-shaped armature 4 with a first leg 5 and a second leg 6. Furthermore, the transducer comprises a magnet assembly 7 for providing a magnetic field in an air gap 8, and a coil 9 comprising a coil tunnel 10. The coil tunnel 10 and the air gap 8 extend substantially parallel to each other, and the first leg 5 extends in a first direction through the coil tunnel 10 and the second leg 6 extends in a second direction through the air gap 8.

The first and second directions both extend along the X-direction illustrated by the arrow X. The X-direction corresponds to the extent of the legs 5, 6 of the U-shaped armature 4. The Z-direction which is illustrated by the arrow Z is parallel to a line extending through both the legs of the U-shaped armature. The Y-direction is perpendicular to both the Z- and the X-directions.

The transducer 1 is adapted to transform electrical energy into mechanical energy by movement of the second leg 6 of the U-shaped armature 4 whereby sound waves are created by movement of the membrane 11 which is coupled to the armature 4. A soft suspension element 11' is provided allowing the membrane 11 to move in relation to the housing while preventing air flow from the upper side of the membrane 11 to the lower side thereof. Naturally, a vent may be provided allowing DC pressure equalization between the space below the membrane and that above the membrane.

The magnet assembly 7 is embodied as a first magnet portion 7*a* and a second magnet portion 7*b* positioned on opposite sides of the second leg 6.

The coil 9 is formed as a tubular element and comprises a number of windings defining the coil tunnel through which the first leg 5 extends. A first part of the coil 9*a* and the first magnet portion 7*a* is positioned in the area between the first leg 5 and second leg 6, whereas a second part of the coil 9*b* and the second magnet portion 7*b* is positioned outside the area, thus forming a stacked/layered transducer in the Z-direction.

The U-shaped armature 4 is formed so that both legs 5, 6 are attached to a bent portion 12 which forms the bottom of the U. The bent portion 12 extends in the Z-direction.

The armature 4 has a fixed end portion 13 where an end portion of the first leg 5 is attached to an attachment point of the housing. At the opposite end, the U-shaped armature 4 has an end portion 14 which may move freely in the chamber 3. The first leg 5 comprises the fixed end portion 13 and the second leg 6 comprises the free end portion 14. Alternatively, the first leg 5 may be attached along a portion thereof from the end portion toward the bent portion 12, as long as the bent portion 12 and a portion of the first leg 5 closer to the bent portion 12 is movable in relation to the attachment point.

The housing 2 comprises a sound opening 15 for outlet of sound. In general, the direction of sound may be reversed so that the present transducer 1 acts as a sound detector or microphone.

A suspension 16 is attached to a fixation point of the housing 2, extends in the housing in the X-direction and is attached to the coil 9 and the magnet assembly 7 in order to at least partly support the magnet assembly 7 and the coil 9. Alternatively, the coil 9 may be attached to the housing or even to the first leg 5.

It is seen that the membrane 11 extends in the air gap 8, so that the magnet portion 7*b* is positioned in the front chamber (with the sound opening) and the magnet portion 7*a* in the back chamber (the chamber on the opposite side of the membrane 11).

The housing 2 comprises a top wall 17, a bottom wall 18, and one or more side walls of which two opposite side wall portions 19, 20 are illustrated which extend between the top wall 17 and the bottom wall 18. The top wall 17 and the bottom wall 18 form part of the outer surface of the housing and are positioned highest and lowest in the Z-direction. The two side wall portions 19, 20 also form part of the outer surfaces and are positioned at each end of the housing 2 in the X-direction. The width of the housing 2 is defined by two additional side wall portions (not shown) being positioned at each end of the housing in the Y-direction.

Figure 2:
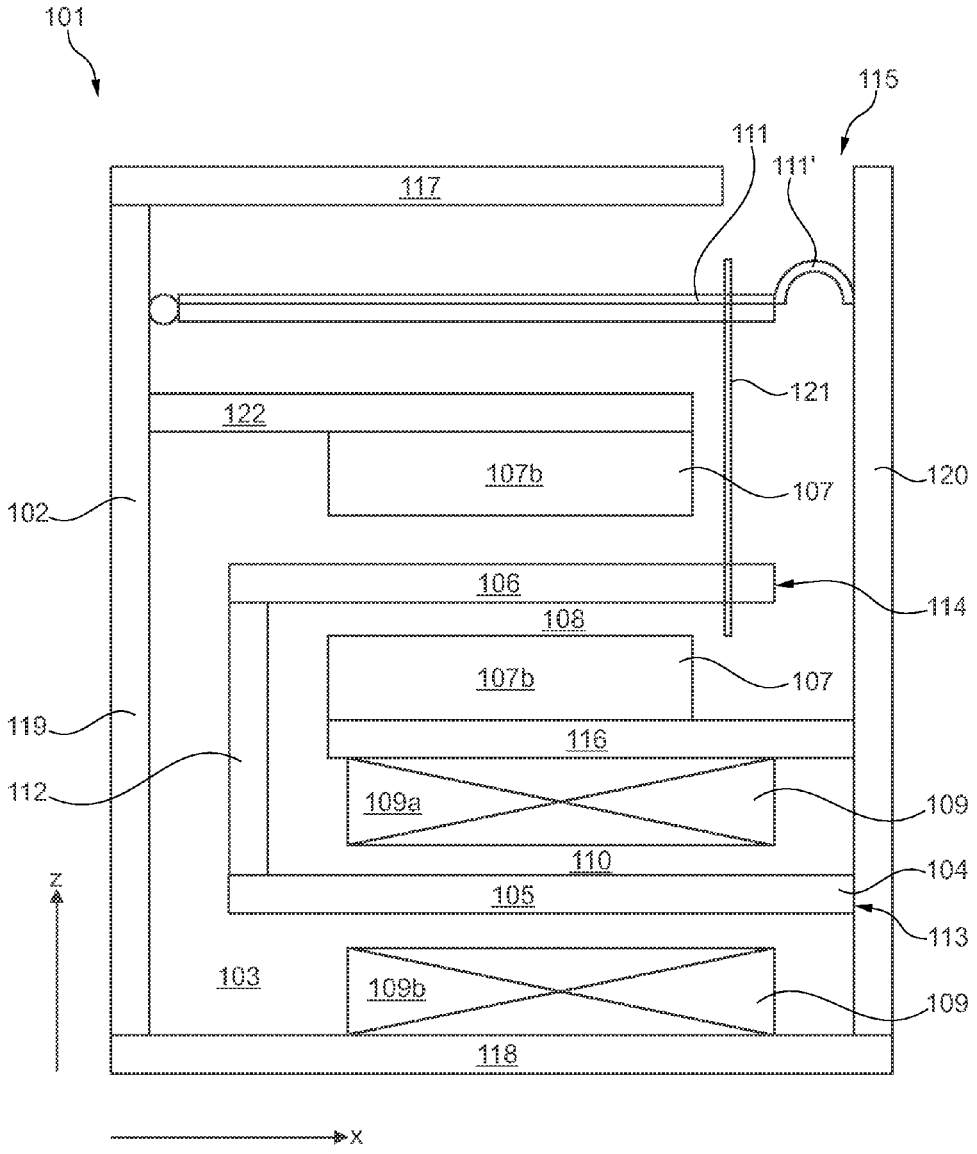

FIG. 2 illustrates a second embodiment of a transducer 101 according to the invention. The transducer 101 is similar to the transducer 1 illustrated in FIG. 1. However, the membrane 111 is positioned above the second magnet portion 107*b* and is operationally attached to the second leg 106 a by a drive pin 121.

Furthermore, a second suspension 122 is attached to a second fixation point of the housing 102 and extends in the housing in the X-direction. The second suspension 122 is attached to the magnet assembly 107 to thereby at least partly support the magnet assembly 107.

Figure 3:
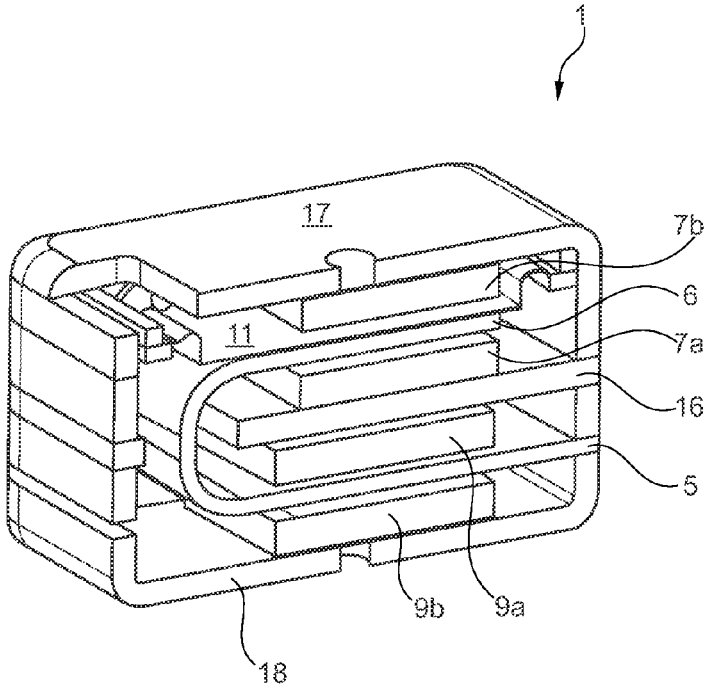
FIG. 3 is a 3D illustration of the first embodiment of the transducer schematically illustrated in FIG. 1.

FIG. 3 is a 3D illustration of the first embodiment of the transducer 1 schematically illustrated in FIG. 1.

Figure 4:
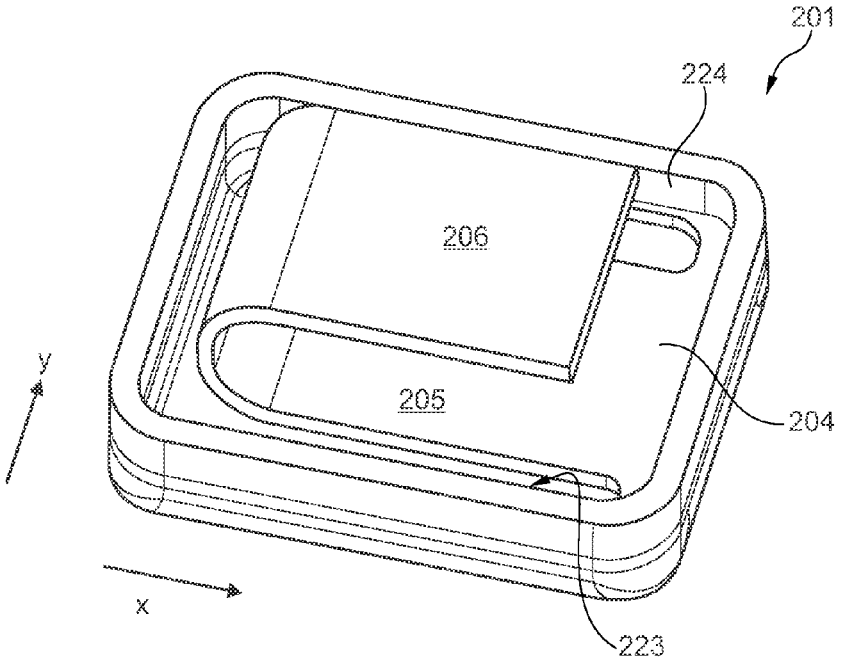
FIG. 4 is a 3D illustration of an alternative embodiment of a transducer according to the invention.
Figure 5:
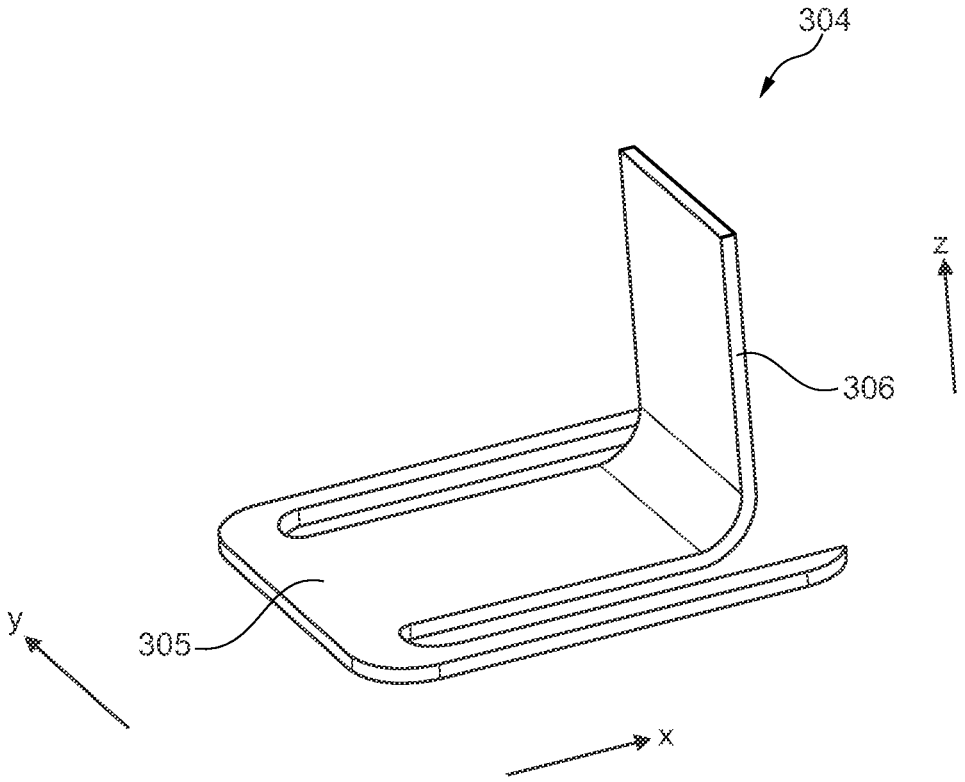
FIG. 5 illustrates an L-shaped armature.

FIG. 4 is a 3D illustration of an alternative embodiment of parts of a transducer 201 according to the invention. The transducer 201 comprises a U-shaped armature 204 which comprises a first support portion 223 (not shown) and a second support portion 224 configured for supporting the armature 204 in the housing 202. The armature 204 is attached to the housing 202 by these support portions 223, 224 in the same manner as typical E-shaped armatures. The first and second support portions 223, 224 are attached to the housing 202 along their length in the X-direction, and extend parallel to the first leg 205, whereby the first leg 205 and the two support portions 223, 224 together form an E which extends in the Y-direction. The first leg 205 thus is attached to the housing at an end thereof FIG. 5 illustrates an L-shaped armature 304 for use in another embodiment of a transducer according to the invention. This L-shaped armature may be used in a transducer, wherein the coil tunnel and the air gap extend transverse to each other. The L-shaped armature 304 may be positioned so that the first leg 305 extends in the X-direction and so that the second leg 306 extends in the Z-direction, whereby the legs extend substantially perpendicular to each other.

The first leg 305 may be arranged so that it extends in a first direction through the air gap and the second leg 306 may be arranged to that it extends in a second direction through the coil tunnel. The membrane may thus be attached to the leg 306, as the magnet assembly will make the leg 305 move in the Z direction.

Figure 6:
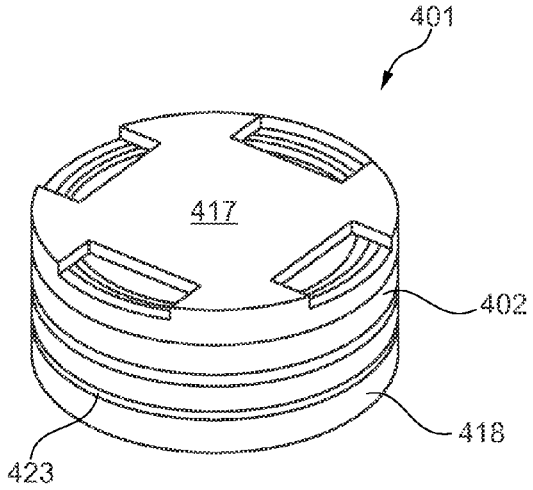
FIGS. 6, 7, and 8 illustrate different views of a further embodiment of a transducer according to the invention.
Figure 7:
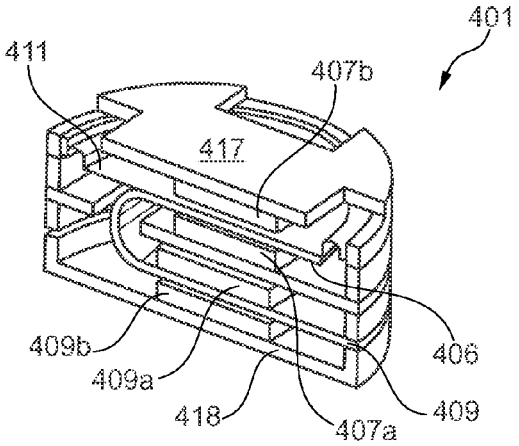
Figure 8:
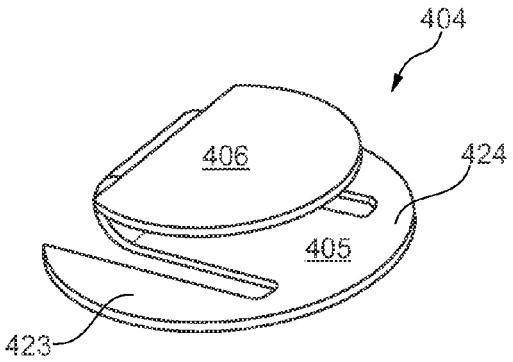

FIGS. 6, 7, and 8 illustrate different views of a further embodiment of a transducer 401 having a substantially circular shape in the X-Y plane.

FIG. 6 illustrates the transducer 401 comprising a circular housing 402. The housing comprises a circular top wall 417 and a circular bottom wall 418 (see FIG. 7). The sidewall 419 is substantially tube shaped.

FIG. 7 is a cross-sectional view through the transducer 401. The layout of the transducer 401 is similar to the transducer 1 of FIG. 1 except for the circular shape. The first armature leg 405 extends between the first and second parts of the coil 409*a*, 409*b*. The second armature leg 406 and the membrane 411 extend between first and second magnet portions 407*a*, 407*b*.

FIG. 8 illustrates a U-shaped armature 404 for use in the transducer 401. The armature comprises a first support portion 423 and a second support portion 424 configured for supporting the armature 404 in the housing 402. The armature 404 is attached to the housing 402 by these support portions 423, 424 (see FIG. 6).

The invention claimed is:

1. A transducer comprising:

a housing defining a chamber, a U-shaped armature having at least a first leg and a second leg, the first leg having a first length, and a bent portion interconnecting the first and second legs, a magnet assembly configured to provide a magnetic field in an air gap, and a coil comprising a coil tunnel, wherein the armature extends through the air gap and the coil tunnel and is fixed to the housing at an end portion of the first leg, so that the second leg and at least a portion of the first leg, the portion extending from the bent portion and comprising at least 50% of the first length, are movable in relation to the housing, wherein the armature has a U-shaped portion where the first leg and the second leg are substantially parallel, and wherein the coil tunnel and the air gap extend substantially parallel to each other, and wherein one of the second leg and the portion of the first leg extends through the coil tunnel and the other of the second leg and the portion of the first leg extends through the air gap.

2. A transducer according to claim 1, wherein the second leg extends through the air gap.

3. A transducer according to claim 1, wherein the second leg and the portion of the first leg are movable in a direction transverse to longitudinal directions of the first and second legs.

4. A transducer according to claim 1, wherein the magnet assembly and the coil are arranged substantially above each other in a direction substantially perpendicularly to the first and second legs.

5. A transducer according to claim 1, wherein the armature is fixed to an attachment point of the housing at an end portion of the first leg.

6. A transducer according to claim 1, wherein the magnet assembly comprises a first magnet portion and a second magnet portion, and wherein a first part of the coil and the first magnet portion are positioned in an area between the first and second legs, and a second part of the coil and the second magnet portion are positioned outside the area.

7. A transducer according to claim 1, further comprising a membrane operationally attached to the second leg.

8. A transducer according to claim 7, further comprising a suspension attached to a fixation point at the housing, the suspension extending in the housing and being attached to the coil and the magnet assembly.

9. A transducer according to claim 1, further comprising a suspension attached to a fixation point at the housing, the suspension extending in the housing and being attached to the coil and the magnet assembly.

10. A transducer according to claim 9, wherein the suspension is positioned between the membrane and the attachment point.

11. A transducer according to claim 9, wherein the suspension is positioned between the membrane and the attachment point.

12. A transducer according to claim 1, wherein the housing comprises a top wall, a bottom wall, and one or more side walls extending between the top wall and the bottom wall, a distance between the top wall and the bottom wall being in the range of 0.5-5.0 mm.

13. A transducer according to claim 12, wherein a distance between two opposing side wall portions is in the range of 2.0-5.0 mm.

14. A transducer according to claim 1, wherein the chamber has a volume in the range of 10-20 $mm^3$.

15. A transducer comprising: a housing defining a chamber, an L-shaped armature having at least a first leg and a second leg, the first leg having a first length, and a bent portion interconnecting the first and second legs, a magnet assembly configured to provide a magnetic field in an air gap, and a coil comprising a coil tunnel, wherein the armature extends through the air gap and the coil tunnel and is fixed to the housing at an end portion of the first leg, so that the second leg and at least a portion of the first leg, the portion extending from the bent portion and comprising at least 50% of the first length, are movable in relation to the housing, and wherein the first leg extends in a first direction through the coil tunnel and the second leg extends in a second direction through the air gap, wherein the coil tunnel and the air gap extend transverse to each other.

* * * * *